United States Patent [19]

Reges

[11] 4,381,760

[45] May 3, 1983

[54] FIREPLACE INSERT WITH FORCED AIR FLOW HEAT EXCHANGER

[76] Inventor: James C. Reges, Rte. 3, Box 208, Rocky Mount, N.C. 27801

[21] Appl. No.: 189,745

[22] Filed: Sep. 23, 1980

[51] Int. Cl.[3] ..... F24B 7/00

[52] U.S. Cl. ..... 126/123; 126/126; 126/138; 237/51

[58] Field of Search ..... 126/61, 63, 66, 121, 126/123, 126, 138; 237/51

[56] References Cited

U.S. PATENT DOCUMENTS

| | | | |
|---|---|---|---|
| 2,642,859 | 6/1953 | Brown | 126/121 |
| 3,981,292 | 9/1976 | Lilly et al. | 126/121 |
| 4,015,579 | 4/1977 | Wirth et al. | 126/121 X |
| 4,015,581 | 4/1977 | Martenson | 126/121 |
| 4,061,189 | 12/1977 | Moncrieff-Yeates | 126/121 X |
| 4,096,849 | 6/1978 | Moncrieff-Yeates | 126/121 |
| 4,191,162 | 3/1980 | Simms | 126/121 X |
| 4,204,517 | 5/1980 | Rumsey | 126/121 X |
| 4,254,756 | 3/1981 | Wells | 126/121 |
| 4,263,889 | 4/1981 | Martenson | 126/121 X |
| 4,266,526 | 5/1981 | Tolotti | 126/123 |
| 4,354,480 | 10/1982 | Henderson et al. | 126/123 |

FOREIGN PATENT DOCUMENTS

| | | | |
|---|---|---|---|
| 547894 | 6/1956 | France | 126/121 |

*Primary Examiner*—Samuel Scott
*Assistant Examiner*—Margaret A. Focarino
*Attorney, Agent, or Firm*—Harvey B. Jacobson

[57] ABSTRACT

A heater for use as a fireplace insert, but which may be modified to function as a free standing heater. The heater includes an inner firebox having inner bottom, top, rear and opposite side walls interconnected along adjacent marginal edges to form a combustion chamber therein. An outer housing is provided for snug reception within a fireplace and the housing includes outer bottom, top, rear, front and opposite side walls. The firebox is received within the housing with at least major portions of the inner bottom, top, rear and opposite side walls spaced inwardly from opposing portions of the outer bottom, top, rear and opposite side walls and the outer front wall closes the front of the firebox. Circulating air inlet structure opens through the front wall into the space between a first set of opposing surfaces of corresponding inner and outer walls and air outlet structure opens through the front wall from the space between a second set of opposing surfaces of corresponding inner and outer walls. The inner and outer walls include coacting portions defining a tortuous path for circulating air to be heated between the inner and outer walls and the tortuous path extends between major portions of the bottom walls, the rear walls, the top walls and the side walls. An access opening is formed in the front wall for providing access to the interior of the combustion chamber and an access door removably closes the access opening.

5 Claims, 4 Drawing Figures

FIREPLACE INSERT WITH FORCED AIR FLOW HEAT EXCHANGER

BACKGROUND OF THE INVENTION

Various forms of fireplace inserts heretofore have been provided for accomplishing more efficient heating of the interior of a building as a result of a fire within the fireplace and with the fire consuming a lesser amount of wood. However, most of these previously known fireplace inserts are constructed in a manner to provide less than maximum pass of air to be heated over heated surfaces of the fireplace inserts with the result that considerable heat of combustion from the fire within the fireplace insert passes outwardly therefrom with the flue gases. In addition, many previously known forms of fireplace inserts have a healthy appetite for fuel (wood or coal) to be burned therein and the expense of heating the interior of a residence with such a fireplace insert is not much less than the expense of heating the same residence interior as the result of operation of a conventional central heating system.

Accordingly, a need exists for an improved form of fireplace insert which may be utilized to effectively heat the interior of a residence while burning a minimum amount of fuel.

Examples of various forms of fireplace inserts and other devices including some of the general structural and operational features of the instant invention are disclosed in U.S. Pat. Nos. 1,255,493, 2,052,643, 2,642,859, 2,703,566, 4,015,581 and 4,166,444.

BRIEF DESCRIPTION OF THE INVENTION

The fireplace insert of the instant invention is constructed in a manner whereby an interior combustion chamber is provided for containing a fire and circulatory air to be heated is passed in good heat transfer relation with major portions of the exterior surfaces of all of the walls of the combustion chamber. The front wall of the insert comprises the front wall of the firebox or combustion chamber and thus is effective to create convection room airflow thereover in good heat exchange relation therewith.

The main object of this invention is to provide a fireplace insert which will be capable of large heat output with a minimum amount of fuel being burned therein.

Another object of this invention is to provide a fireplace insert which may be readily utilized in conjunction with substantially all conventional size fireplaces.

Still another object of this invention is to provide a fireplace insert in accordance with the preceding objects and which includes internal blower means for pumping circulatory air therethrough to be heated.

A further important object of this invention is to provide a fireplace insert in accordance with the immediately preceding object and constructed in a manner whereby the blower means will be effectively insulated from extreme heat conditions.

Another object of this invention is to provide a fireplace insert including an ash dump which enables ashes to fall through a grate at the bottom of the firebox and into a removable drawer-type ash container without heat loss and which also aids in starting a fire in the firebox from the ash with assistance from a draft control on the ash container.

Yet another object of this invention is to provide a readily removable ash container by which the effort and mess usually associated with ash removal may be substantially reduced.

A final object of this invention to be specifically enumerated herein is to provide a fireplace insert in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
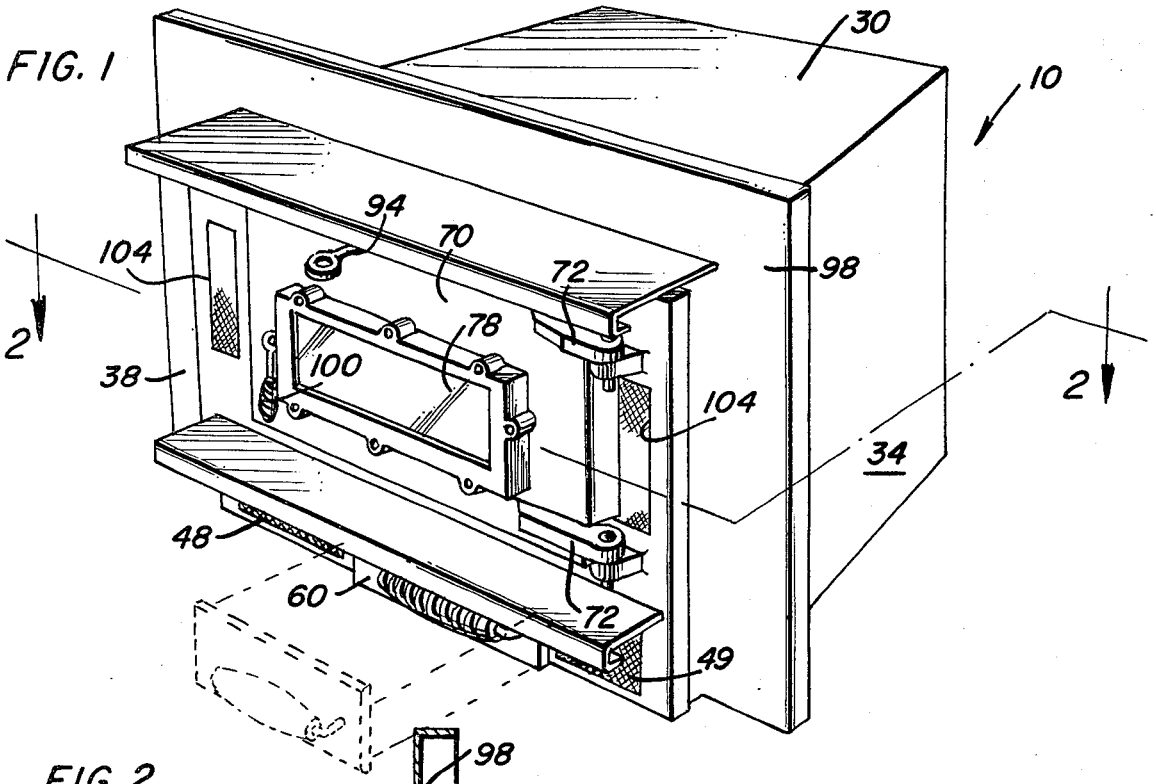
FIG. 1 is a perspective view of the fireplace insert of the instant invention.
Figure 2:
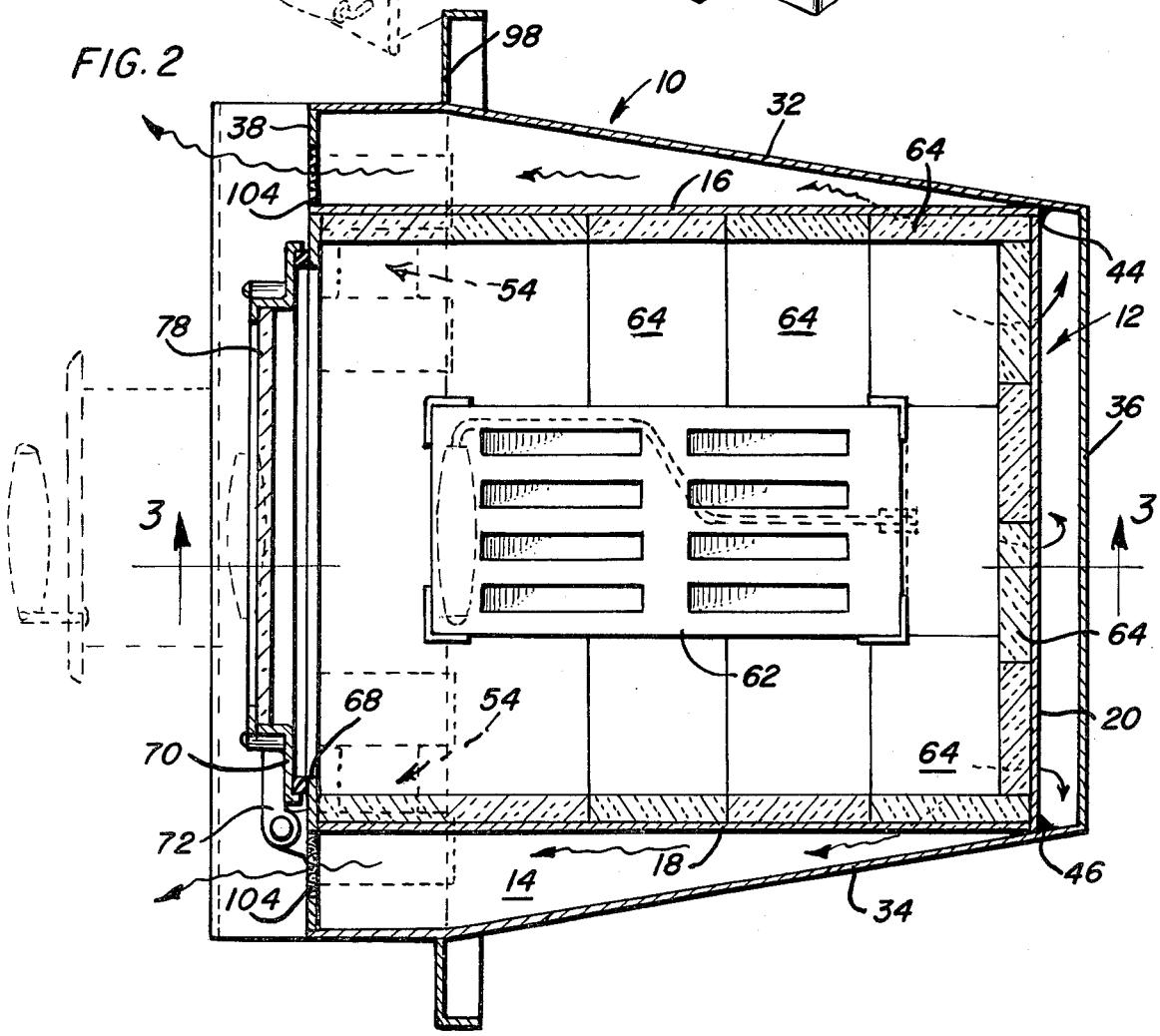
FIG. 2 is an enlarged horizontal sectional view taken substantially upon the plane indicated by the section line 2—2 of FIG. 1.
Figure 3:
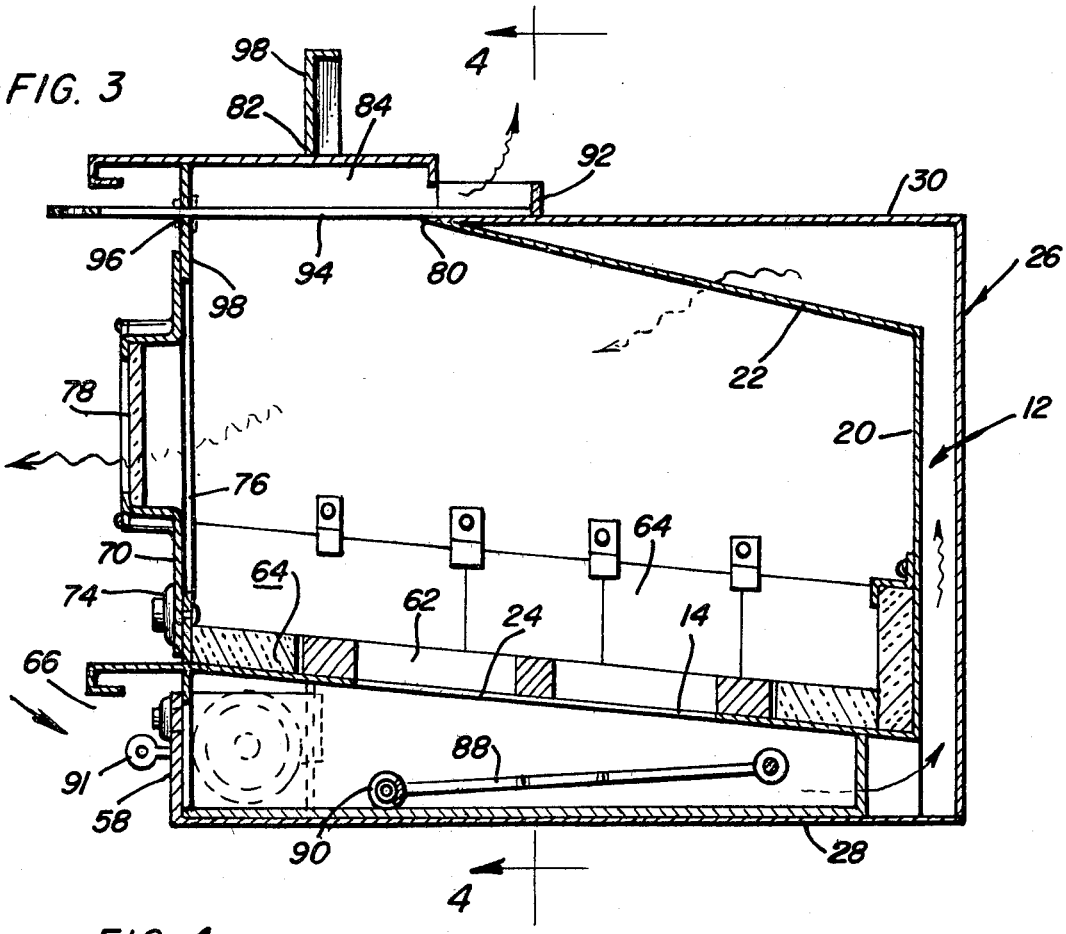
FIG. 3 is a longitudinal vertical sectional view taken substantially upon the plane indicated by the section line 3—3 of FIG. 2.
Figure 4:
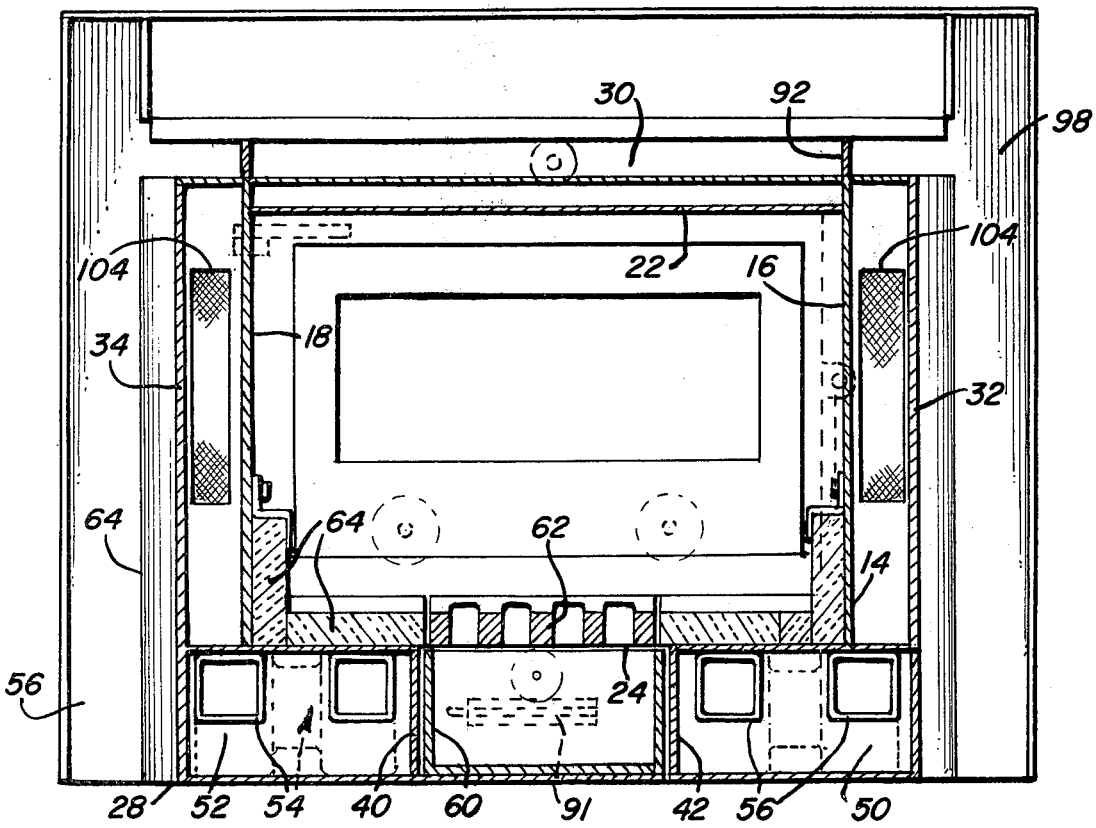
FIG. 4 is a transverse vertical sectional view taken substantially upon the plane indicated by the section line 3—3 of FIG. 4.

Referring now more specifically to the drawings, the numeral 10 generally designates the fireplace insert of the instant invention. The insert 10 includes an inner firebox referred to in general by the reference numeral 12 and including an inner rearwardly and downwardly inclined bottom wall 14, opposite side walls 16 and 18, a rear wall 20 and a rearwardly and downwardly inclined top wall 22. The central portion of the bottom wall 14 has an opening 24 formed therein.

The insert 10 additionally includes an outer housing referred to in general by the reference numeral 26 and the outer housing 26 includes a bottom wall 28, a top wall 30, opposite side walls 32 and 34, a rear wall 36 and a front wall 38.

The firebox 12 is contained within the outer housing 26 and a pair of rearwardly tapering and upstanding front-to-rear extending partitions 40 and 42 are secured between the bottom walls 14 and 28 on opposite sides of the opening 24 and define an ashpit therebetween. The bottom wall 14 includes opposite side marginal edges which project outwardly beyond the side walls 16 and 18 of the firebox 12 and are secured, as by welding, to the opposite side walls 32 and 34 of the housing 26. Also, the rear portions of the opposite side walls 32 and 34 of the housing 26 converge rearwardly and are secured to the rear upstanding corners 44 and 46 of the firebox 12 in any convenient manner such as by welding. Further, the side walls 32 and 34 project rearwardly beyond the rear wall 20 of the firebox 12.

The opposite sides of the front wall 38 have a pair of low opposite side air inlet openings 48 and 49 formed therein and a pair of transverse partitions 50 and 52 are secured between the bottom walls 14 and 28 a spaced distance rearward of the front wall 38 and also are secured between the partitions 40 and 42 and the lower marginal portions of the side walls 32 and 34 below the bottom wall 14.

A pair of twin squirrel cage blower assemblies 54 are disposed between the transverse partitions 50 and 52 and the front wall 38 and include outlets opening through a pair of openings 56 formed in each partition 50 and 52. The air inlet openings 48 and 49 include grilles thereover and supply circulation air to the blower assemblies 54. The center lower marginal portion of the front wall 38 includes an access opening 58 formed therein through which a drawer-type receptacle 60 is slidingly received and a grate 62 is disposed within the bottom of the firebox 12 in registry with the opening 24. In addition, the lower portions of the firebox 12 are lined with suitable fire bricks 64.

The drawer 60 is provided for receiving ashes through the grate 62 and the drawer 60 includes an air inlet opening in its front wall provided with an adjustable damper 66. Further, the front wall 38 includes an access opening 68 formed therein and a closure door 70 is hingedly supported from the front wall 38 through the utilization of hinges 72 for removably closing the opening 68. The door 70 includes additional air inlet openings provided with rotary dampers 74 and the door 70 further includes an inspection port 76 having a heat resistant glass window 78 therein.

The forward portion of the top wall 22 is secured as at 80 to a foreshortened central portion of the top wall 30 and a downwardly and rearwardly opening extension 82 is secured over the forward portion of the top wall 30 and defines a flue outlet 84.

The drawer 60 includes a pivotally mounted support arm 88 provided with a handle 90 on its free end. The support arm handle 90 and a similar handle 91 carried by the front wall of the drawer 60 may be used to carry the drawer from the insert 10 in order to dump ashes therefrom.

The flue outlet 84 has a sliding damper member 92 operatively associated therewith and disposed in sliding support from the top wall 30. An operating rod 94 is attached to the damper 92 and is slidingly received through a grommet 96 secured in an opening 98 provided in the central upper marginal portion of the front wall 38. The flue outlet 84 opens rearwardly behind the mounting flange 98 which extends across the upper marginal portion of the outer housing 26 and downwardly along the forward marginal portions of the opposite side walls 32 and 34 of the outer housing 26. The mounting flange 98 may be provided with suitable thermocord seal strips extending thereabout. In addition, the peripheral edges of the door 74 are also provided with thermocord seal strips and the front wall of the tray 60 is equipped with similar thermocord. The door 70 is provided with a handle 100 by which the door 70 may be opened and closed and the flue outlet 84 opens directly rearwardly and upwardly into the flue outlet of the associated fireplace against whose forward surface the mounting flange 98 rearwardly abuts. The damper 92 controls the flow of flue gases from the flue gas outlet 84 into the flue outlet for the associated fireplace.

The front wall 38 further includes a pair of opposite side intermediate height air outlets 104 which open into the forward extremity of the space between the inner and outer side walls of the firebox and housing above the bottom wall 14.

In operation, the insert 10 is placed within a conventional fireplace in a manner which is believed to be obvious with the rear marginal edges of the mounting flange 98 abutted against the outer front face of the fireplace. A wood or coal fire may be started within the firebox 12 on or above the grate 62 and a suitable amount of combustion air may be admitted into the firebox 12 through the dampers 74. Also, the adjustable damper 66 may be utilized if desired. The blower assemblies 54 are operatively associated with a suitable source of electrical potential (possibly in operative association with a thermostat for sensing the temperature between the bottom walls 14 and 28) and air to be heated is drawn inwardly through the air inlet openings 48 and 49 and passes rearwardly beneath the heated undersurfaces of the bottom wall 24 on remote sides of the partitions 40 and 42. The air then passes upwardly between the rear walls 20 and 36 and forwardly across the top wall 22. The circulating air then passes forwardly and downwardly over the exterior surfaces of the side walls 16 and 18 and outwardly through the air outlets 104 for heating the room into which the insert 10 faces. Either a wood or coal fire may be provided within the firebox 12 and when it is desired to remove ashes from the firebox 12, those ashes may be deflected downwardly through the grate 63 and into the drawer 60. Thereafter, drawer 60 may be removed and carried to a disposal point through utilization of the handles 91 and 90.

The drawer 60 is in reasonably good sealed engagement with the front wall 38 and the door 72 is also sealed relative to the front wall 38. Accordingly, a fire within the firebox 12 may be quickly extinguished merely by closing the dampers 66 and 74. In an overnight fire situation the dampers 74 may be closed and the damper 66 opened slightly in order that barely enough combustion air may be admitted into the firebox 12 through the drawer 60 in order to maintain minimum combustion of wood or coal within the firebox 12.

The blower assemblies 54 are spaced forward of the grate 62 and beneath the bottom wall 14 and are thus substantially protected from the heat of combustion within the firebox 12. In addition, the blower assemblies 54 are maintained in a cooled state by fresh air to be heated moving toward the blower assemblies 54 through the air inlet openings 48 and 49.

When the insert 10 is in operation, air to be heated is blown over the exterior surfaces of major portions of not only the top and bottom walls 22 and 14 of the firebox 12 but also the rear wall 20 of the firebox 12 as well as the side walls 16 and 18 thereof. Accordingly, the insert 10 is highly efficient in the transfer of heat from the firebox 12 to the air being circulated through the insert 10.

As previously indicated, the insert may readily be provided in the form of a free standing heater by the addition of depending support legs, or the like, elimination of the mounting flange 98 and the provision of connecting structure for the outlet 84 to adapt it for connection to a flue pipe.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A fireplace insert having an inner firebox including inner bottom, top, rear and opposite side walls interconnected along adjacent marginal edge portions to form a combustion chamber therein, an outer housing for snug reception within a fireplace, said housing including outer bottom, top, rear, front and opposite side walls, said firebox being received within said housing with the front thereof closed by the front wall of said housing and at least major portions of said inner bottom, top, rear annd opposite side walls spaced inwardly from opposing portions of said outer bottom, top, rear and opposite side walls, means dividing the space between said inner and outer bottom walls into a central front-to-rear and opposite side walls spaced inwardly from space between said inner and outer rear walls and a pair of opposite side front-to-rear extending air passages closed along their upper portions from the side spaces thereabove defined between corresponding inner and outer side walls of said firebox and housing and opening rearwardly into the rear space between said inner and outer rear walls, said inner bottom wall having an opening formed therein opening downwardly into said ash pit and equipped with a grate, said front wall having a lower central opening formed therein registered with the front end of said ash pit, an ash drawer slidably received in said ash pit for removal through and removably closing said lower central opening, an access opening formed in said front wall above said lower central opening for providing access to the interior of said combustion chamber through said front wall, an access door removably closing said access opening, the rear ends of said side spaces being closed from said rear space and open to the upper space between said top walls, means closing the forward portion of the upper space between said top walls and defining a flue gas outlet opening upwardly from said firebox through a forward portion of said housing top wall, air outlet means opening forwardly through said front wall on opposite sides of said access opening from the forward portions of said side spaces, air pump means operatively associated with said air passages for pumping air therethrough into the opposite side lower portions of the rear space between said rear walls, from the upper portions of said rear space into the rear portion of said upper space, from opposite sides of said upper space down into the upper portions of said side spaces and forwardly from the latter through said air outlet means.

2. The insert of claim 1 wherein said inner top wall is forwardly and upwardly inclined and includes a forward marginal portion sealed relative to said outer top wall rearward of said flue gas outlet.

3. The insert of claim 1 wherein the rear marginal portion of said outer side walls converge toward and are sealed relative to the rear portions of said inner side walls forward of said outer rear wall and along the juncture of the rear ends of said inner side walls with the corresponding side marginal portions of said inner rear wall.

4. The insert of claim 1 wherein the forward portions of said air passages include upstanding partitions extending thereacross, said air pump means being disposed in said forward portions of said air passages forward of said partitions and including outlet means opening rearwardly through said partitions into the rear portions of said air passages.

5. The insert of claim 1 wherein said inner bottom wall is rearwardly and downwardly inclined.

* * * * *